United States Patent [19]

Kasuga

[11] Patent Number: 4,635,541

[45] Date of Patent: Jan. 13, 1987

[54] METHOD OF FEEDING AND TIGHTENING A BAND IN A BAND STRAPPING MACHINE AND APPARATUS THEREOF

[75] Inventor: Yoshiaki Kasuga, Yokohama, Japan

[73] Assignee: Nichiro Kogyo Company Ltd., Yokohama, Japan

[21] Appl. No.: 773,658

[22] Filed: Sep. 9, 1985

[30] Foreign Application Priority Data

Dec. 29, 1984 [JP] Japan ..... 59-281027

[51] Int. Cl.[4] ..... B65B 13/22

[52] U.S. Cl. ..... 100/2; 100/26; 100/32

[58] Field of Search ..... 100/1, 2, 26, 29, 32

[56] References Cited

U.S. PATENT DOCUMENTS

| | | | |
|---|---|---|---|
| 3,420,158 | 1/1969 | Kobiella | 100/2 |
| 4,161,910 | 7/1979 | Leslie | 100/26 |
| 4,218,969 | 8/1980 | Kasuga | 100/26 X |

*Primary Examiner*—Billy J. Wilhite

*Attorney, Agent, or Firm*—Oblon, Fisher, Spivak, McClelland & Maier

[57] ABSTRACT

A feed roller is usually rotated at a high speed; a return roller is fitted to a return shaft rotated at a low speed through a one-way clutch; a rocker roller driven at a high speed is brought into press-contact with the return roller so that the return roller is rotated at a high speed in accordance with the high speed rotation of the rocker roller thereby performing the primary tightening operation for a band; then, the return roller is engaged with the return shaft by the function of the one-way clutch when the rotational speed of the return roller coincides with that of the return shaft, thereby performing the secondary tightening operation with a strong pulling force. The strapping machine having the above mentioned construction provides noiseless and speedy operations for strapping the band around a package.

6 Claims, 6 Drawing Figures

METHOD OF FEEDING AND TIGHTENING A BAND IN A BAND STRAPPING MACHINE AND APPARATUS THEREOF

BACKGROUND OF THE INVENTION

The present invention relates to a method of and an apparatus for feeding and tightening a band in a band strapping machine. Particularly, it relates to a method of feeding a band around a package and giving to the band primary and secondary tightening operations by means of a feed roller rotated in one direction, a return roller disposed in parallel to the feed roller and rotated in the opposite direction and rocker rollers each adapted to come in press-contact with the feed roller and the return roller.

FIG. 1 is a schematic view of a conventional band strapping machine of this type, FIG. 2 is an enlarged front view of a band feeding and tightening apparatus contained in the conventional strapping machine and FIG. 3 is a plan view showing an arrangement of and connection between a feed roller and a return roller of the conventional strapping machine.

In FIGS. 1 to 3, a reference numeral 5 designates a motor placed in the strapping machine body 1. A belt 6 is extended from a shaft of the motor 5 to be wound around a pulley 8 and a pulley of a reduction gear device 7. The pulley 8 is attached to one end of a feed shaft 12. A feed roller 11 is attached to the other end of the shaft 12 and a gear wheel 18 is attached to the intermediate portion of the shaft 12. The feed shaft 12 is supported by a machine frame (not shown) in a freely rotatable manner. A return shaft 15 is provided in parallel to the feed shaft 12. A return roller 13 is attached to an end portion of the return shaft 15 at a position corresponding to the feed roller 11. At the intermediate portion of the return shaft 15, a gear wheel 17 meshing with the gear wheel 18 of the feed shaft 12 is attached through a clutch 16, whereby the return shaft 15 is rotated in the direction opposite to the feed shaft 12. The construction of the clutch 16 is such that it transmits rotation of the feed shaft 12 to the return shaft 15 through the gear wheels 17, 18, and when a load of a predetermined level or greater is applied to the return shaft 15 through the return roller 13, the return shaft 15 is stopped from rotating due to slippage of the clutch 16. The sprocket 14 provided with a clutch therein is provided on the return shaft at a position opposite the return roller 13. A chain 62 is extended between the sprocket 14 and a sprocket body 19 of the reduction gear device 7. By this transmission mechanism, a torque is not transmitted from the return shaft 15 to the sprocket 14, and a rotation of the sprocket body 19 of the reduction gear device 7 causes a rotation of the return shaft 15 in the clockwise direction (the direction indicated by an arrow mark in FIG. 3) by means of the chain 62 and the sprocket 14.

In FIG. 2, above and below the feed roller 11, rocker rollers 30, 31 are respectively pivoted at the top ends of L-shaped levers 32, 33. The bent portion of each of the L-shaped lever is pivoted by a pin 34 or 35. The other end of the lever 32 is connected to an end of the operating rod of an solenoid 42. The other end of the lever 33 is linked to the intermediate portion of the lever 32 by means of a rod 36. A compression spring 37 is fitted between a nut fastened at the other end of the rod 36 and the other end of the L-shaped lever 33.

Below the return roller 13, a rocker roller 40 is pivotally supported at the intermediate portion of a lever 39, whose one end is pivotally supported by the pin 35 and whose other end is connected to an end of an operating rod of a solenoid 41.

The band 4 is passed from the lower part of the feed roller 11 to a space between the feed roller 11 and the rocker roller 31 and a space between the return roller 13 and the rocker roller 40 in this order, and then passed around the return roller 13 by the aid of a band guide 43 and thereafter, passed between the feed roller 11 and the rocker roller 30 and finally, passed into an arch guide 2 set up on a table for packaging (not shown). A reference numeral 3 designates a cam mechanism for clamping, melt bonding and cutting the band wound around a package.

The operation of the conventional band strapping machine will be described.

When the solenoid 42 is actuated, the rocker rollers 30, 31 are brought into press-contact with the outer circumferential surface of the feed roller 11 to feed the band in the arch guide 2. Then, as soon as the solenoid 42 is deenergized, the solenoid 41 is actuated to bring the rocker roller 40 into press-contact with the circumferential surface of the return roller 13 to thereby perform the primary tightening operation for the band. When a tightening force reaches a predetermined value, slippage is caused in the clutch 16 interposed between the return roller 13 and the return shaft 15. Accordingly, revolution speed of the return shaft 15 rapidly decreases. In this case, a rotational force of a low speed and a high torque from the reduction gear device 7 is transmitted to the return shaft 15 by means of the chain 62 and the sprocket 14. Thus, a strong secondary tightening operation is given to the band.

The conventional method and apparatus have encountered the following disadvantage. Namely, when change is made from the primary tightening operation i.e. a high speed operation to the secondary tightening operation, i.e. a low speed operation, there takes place a shock at the time of completion of the primary tightening operation which is caused by structural elements of the strapping machine having large mass, such as the return roller 13, the return shaft 15 and the friction clutch (the follower part) provided on the return shaft. The shock is added to the primary tightening operation. Accordingly, when a solid article such as a wooden box is packaged, fairly large noise is generated due to the shock. When a carton box which is weaker than a wooden box is packaged, it is sometimes broken.

In the conventional strapping machine, the return roller is rotated at a high speed when the feed roller performs feeding of the band at a high speed. Accordingly, when timing in the band feeding operations is not properly adjusted, a trouble of contact takes place between the band and the return roller, particularly the return roller becomes worn after a short term and is damaged by heat of friction.

SUMMARY OF THE INVENTION

It is an object of the present invention to provide a method and an apparatus for feeding and tightening of a band for the strapping machine capable of an increase in packaging efficiency by reducing a shock produced at a transition time from the primary tightening operation to the secondary tightening operation for the band.

An aspect of the present invention is to provide a band-feeding and tightening apparatus for a band strapping machine comprising a strapping machine body, a feed shaft supported by the strapping machine body so as to be rotated at a high speed, a feed roller attached to the feed shaft, a return shaft supported by the machine body in parallel to the feed shaft so as to be rotatable, a return roller attached to the return shaft, a first rocker roller adapted to come in press-contact with the feed roller and a second rocker roller adapted to come in press-contact with the return roller, in which a one-way clutch is interposed between the return shaft and the return roller to allow the rotation of the return roller in the direction of pulling back a band and to engage the return roller with the return shaft when the rotational speed of the return roller substantially coincides with that of the return shaft and the second rocker roller is rotated at an angular speed higher than that of the return roller.

Another aspect of the present invention is to provide a method of feeding and tightening a band in a band strapping machine which comprises feeding a band around a package by bringing a first rocker roller into press-contact with a feed roller rotated at a high speed; bringing a second rocker roller driven at a high speed into press-contact with a return roller driven at a lower speed so that the return roller is caused to rotate at a high speed on a return shaft driven at a low speed in accordance with the high speed rotation of the second rocker roller thereby performing a primary tightening operation, and engaging the return roller with the return shaft when the band is fitted around a package and a speed of the return roller coincides with the low rotational speed of the return shaft, wereby a rotational force of a low speed and a high torque of the return shaft is transmitted to the return roller, for the secondary tightening operation.

DETAILED DESCRIPTION OF THE PREFERRED EMBODIMENTS

An embodiment of the present invention will be described with reference to drawing.

Figure 1:
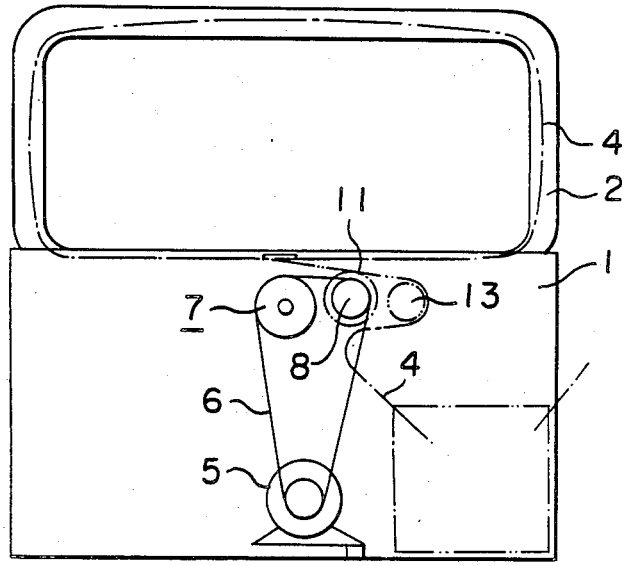
FIGURE 1 PRIOR ART
FIG. 1 is a diagram of a conventional band strapping machine.
Figure 2:
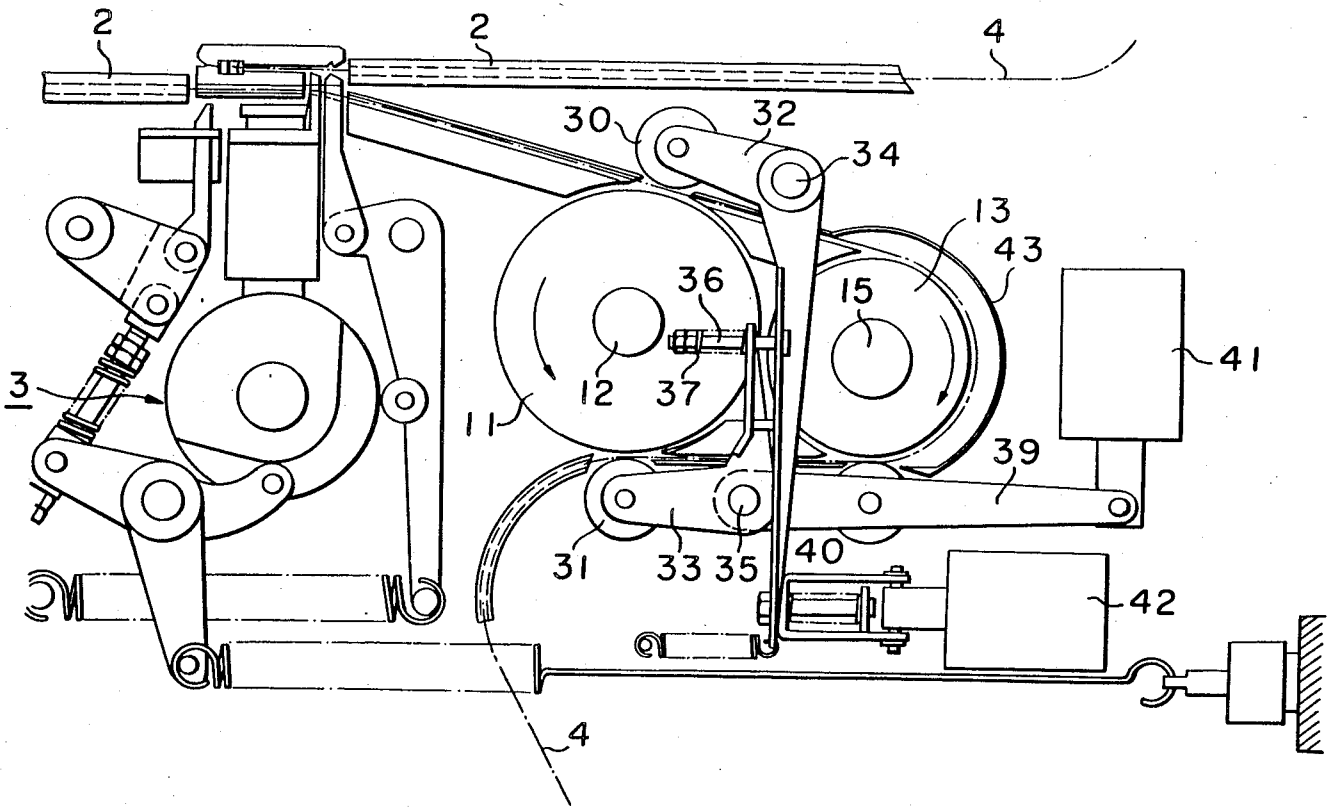
FIGURE 2 PRIOR ART
FIG. 2 is an enlarged front view showing a band-feeding and tightening apparatus of the conventional strapping machine.
Figure 3:
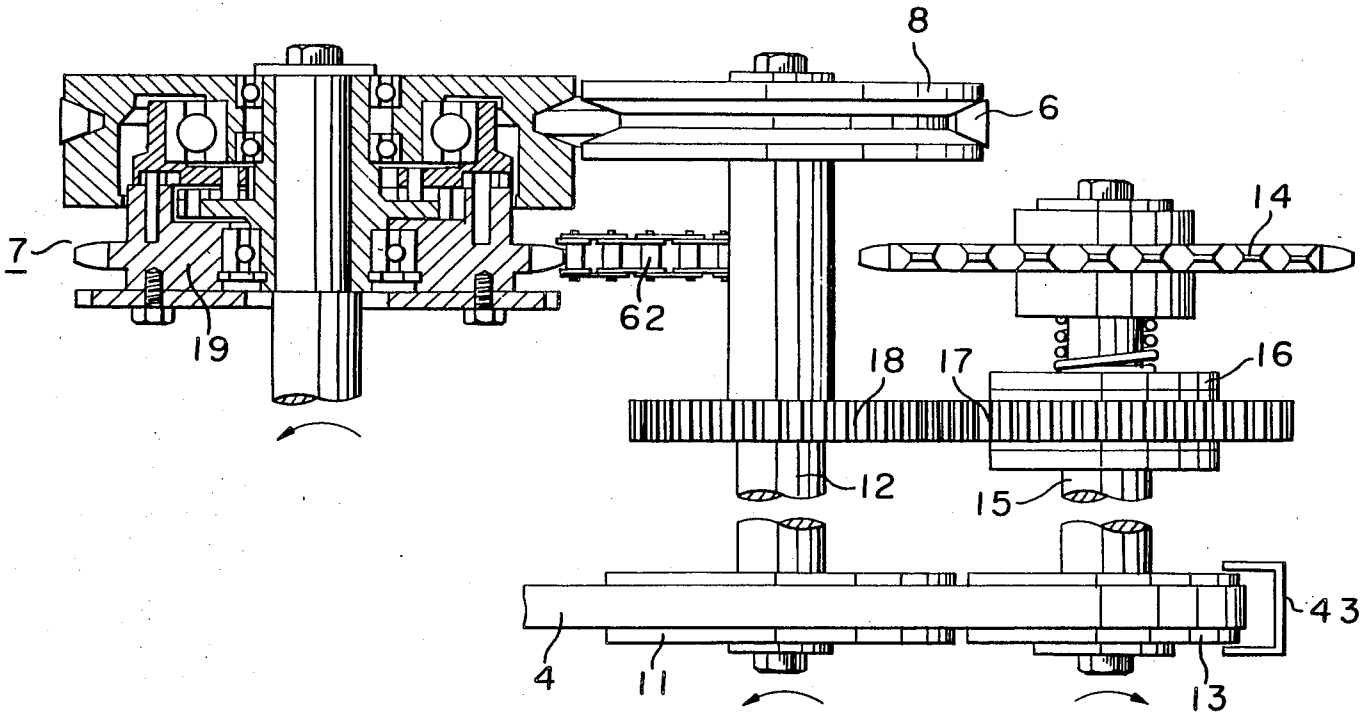
FIGURE 3 PRIOR ART
FIG. 3 is a plan view of the conventional band-feeding and tightening apparatus.
Figure 4:
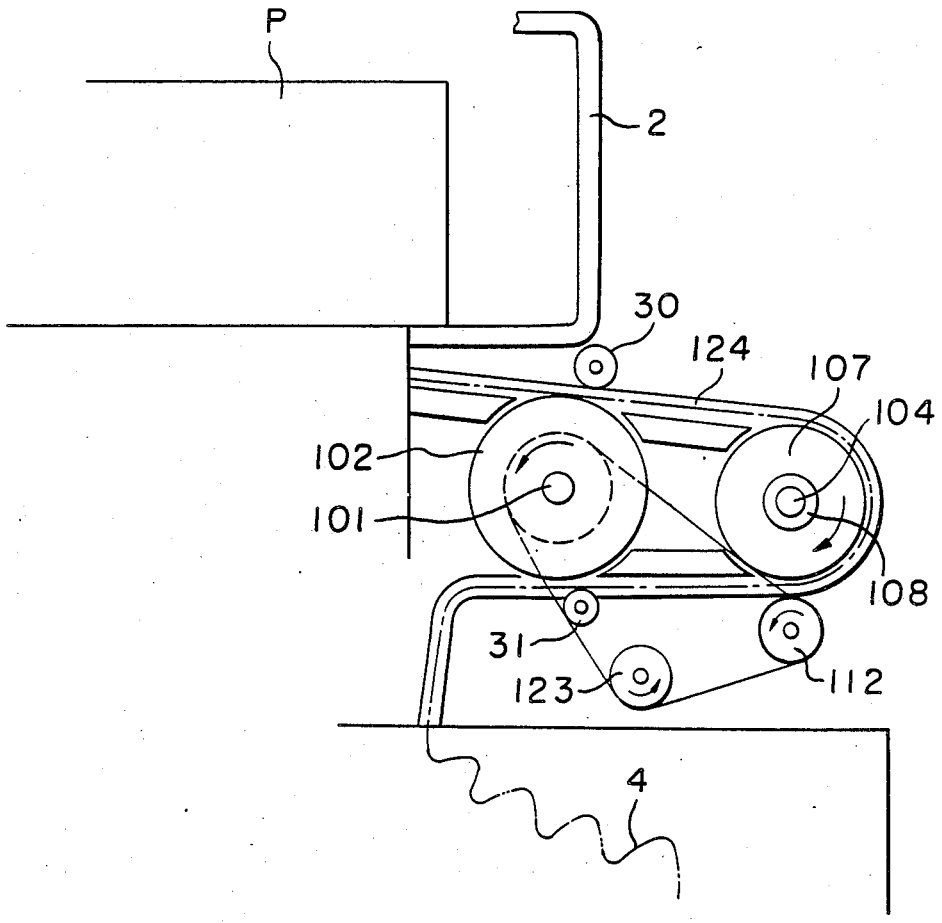
FIG. 4 is a diagram showing an embodiment of the band-feeding and tightening apparatus according to the present invention.
Figure 5:
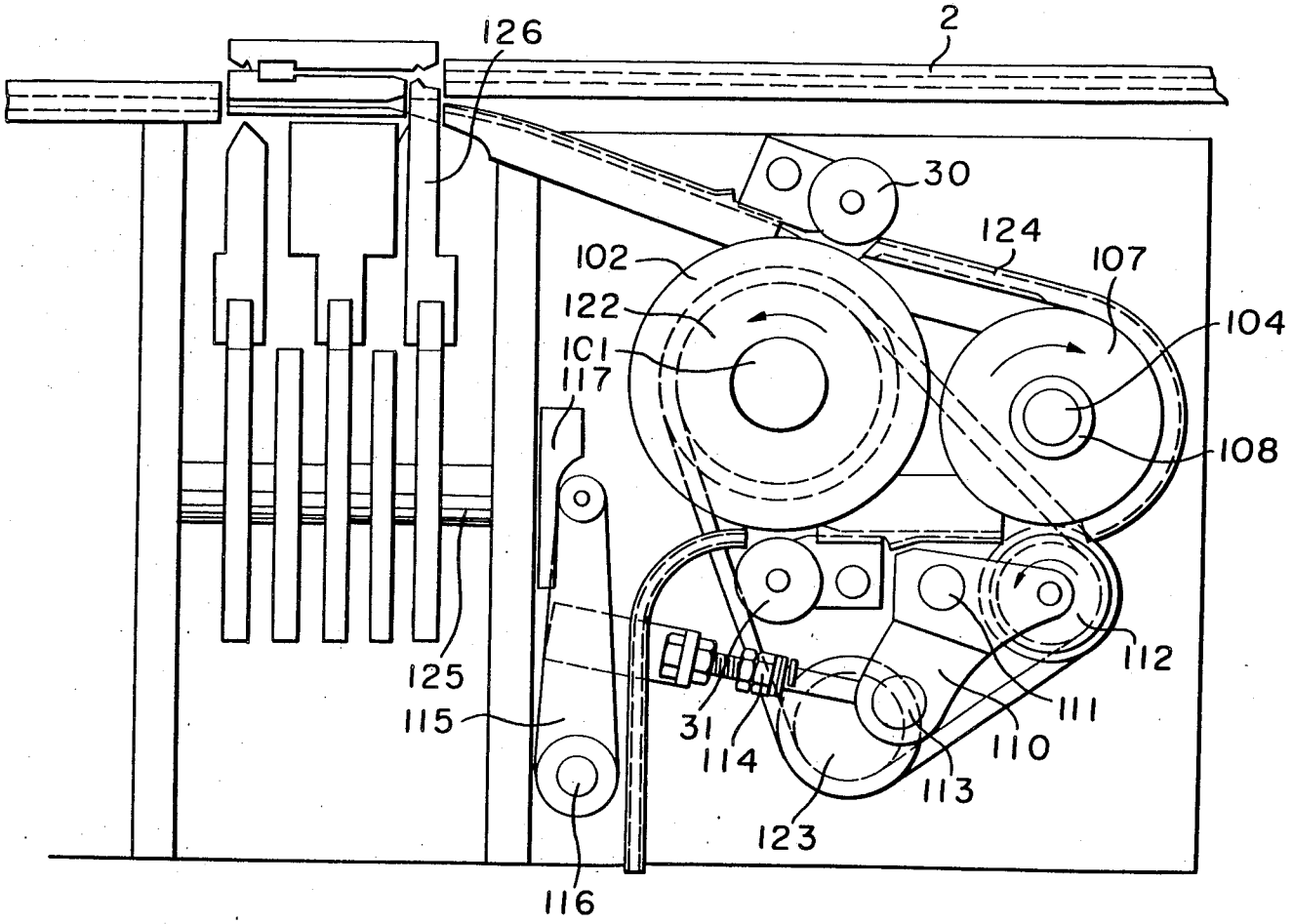
FIG. 5 is an enlarged front view showing in more detail of an embodiment of the band-feeding and tightening apparatus in FIG. 4.
Figure 6:
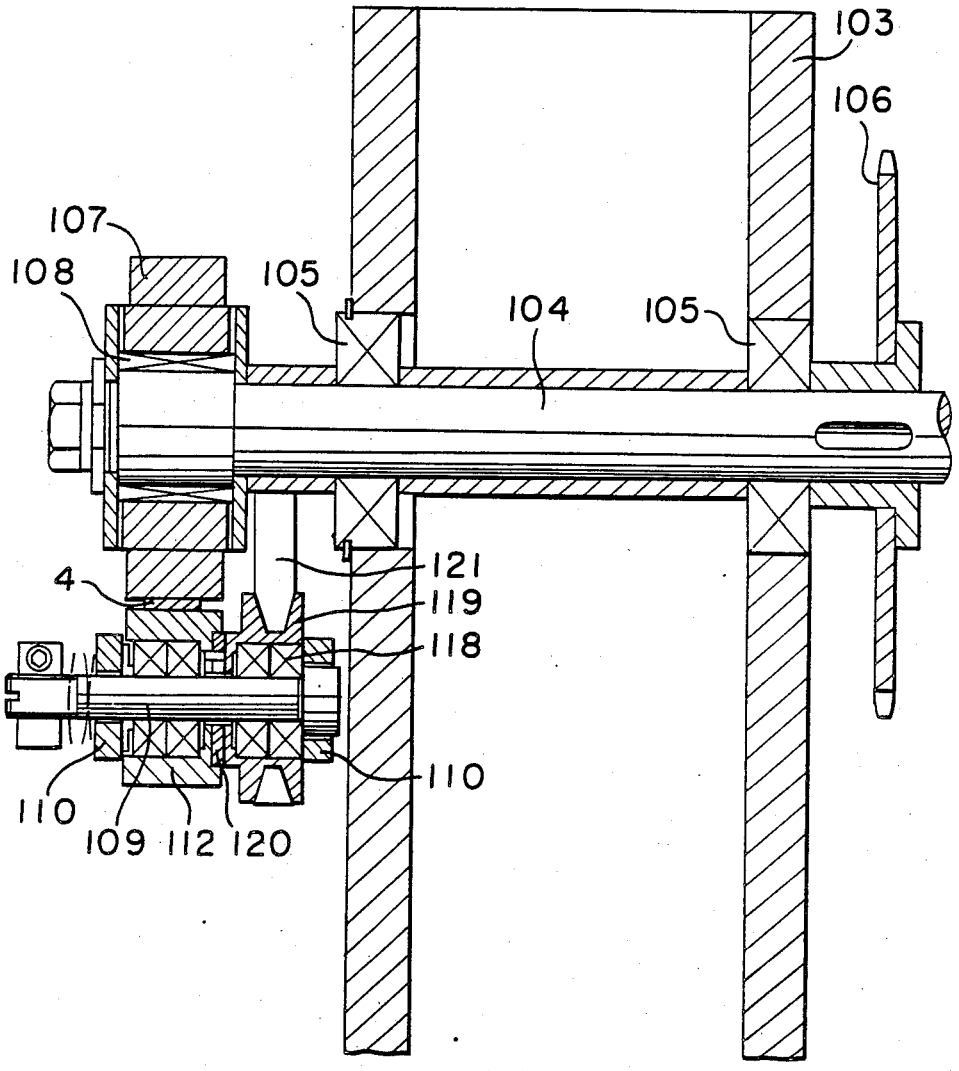
FIG. 6 is a plan view showing an arrangement and connection of a return shaft, a return roller and a rocker roller according to an embodiment of the present invention.

In FIGS. 4 to 6, a reference numeral 101 designates a feed shaft having an end attached with a feed roller 102. The feed shaft 101 is supported by a frame 103 of the strapping machine body so as to be rotatable at a high speed by receiving a driving force from a reduction gear device through a pulley and a belt as is in the conventional apparatus. A return shaft 104 is placed in parallel to the feed shaft 101 and is supported by the frame 103 by means of bearings 105. A sprocket 106 is attached to the return shaft 104 so that the return shaft is rotated by receiving a driving force at a speed lower than that of the feed shaft, by the reduction gear device through a chain (not shown). A return roller 107 is fitted to one end of the return shaft 104 by interposing a one-way clutch 108 so as to be freely rotatable in the direction pulling back the band 4.

Below and in parallel to the return shaft 104, a rocker roller shaft 109 is supported by a pair of arm members 110. Each of the arm members 110 is formed in a substantially triangle shape. Each of the arm members 110 is pivotally supported by a pivot pin 111 at their one apex of the triangular arms. A rocker roller 112 is rotatably supported by the second apex of the arm members. Further, the third apex 113 of the arm members 110 is linked by an end of an operating rod 114. The other end of the rod 114 is connected to the intermediate portion of a lever 115. One end of the lever 115 is pivotally supported by a pivot pin 116 and the other end is free so that it moves in lateral direction in accordance with the shape of a cam portion of a cam 117 when the cam 117 is rotated. Accordingly, when the free end of the lever 115 is on the cam portion, the arm members 110 swing around the pivot pin 111 in the counter clockwise direction, and the rocker roller 112 is brought to press-contact with the return roller 107. The rocker roller 112 is placed adjacent to a pulley 119 by interposing a friction disk 120 therebetween, the pulley 119 being rotatably supported by the shaft 109 through a bearing 118. A V-belt 121 is extended on the pulley 119, a pulley 122 secured to the feed shaft 101 and a tension pulley 123 provided below the feed shaft. Accordingly, the rocker roller 112 is rotated at a speed higher than an angular speed of the return shaft 104 when the feed shaft 101 is rotated.

Above and below the feed roller 102, rocker rollers 30, 31 are provided. They are adapted to be brought into contact with the feed roller 102 by means of solenoids and levers (not shown) as in the conventional apparatus.

In FIGS. 4 to 6, a reference numeral 124 designates a band guide, a numeral 125 designates a cam shaft, a numeral 126 designates a right gripper and a symbol P designates a package.

The operation of the band-feeding and tightening apparatus will be described. When a solenoid (not shown) is actuated, the rocker rollers 30, 31 are brought into contact with the feed roller 102 to initiate feeding of the band 4. When the band 4 is guided in the arch guide 2 set up on the table and the band feeding operation is finished, the cam shaft 125 is rotated to grip the leading end of the band 4 by the right gripper 126. Then, the solenoid is deenergized to separate the rocker rollers 30, 31 from the feed roller 102. At the same time, the cam shaft 125 is further rotatated so that the return rocker roller 112 which is driven at a high speed is brought into contact with the band 4 which is pressed between the return roller 107 and the rocker roller 112 return roller 107. Accordingly, the return roller 107 which has been driven at a low speed receives a rotational force of a high speed from the rocker roller 112, whereby the return roller 107 is rotated at the same speed as the speed of band-returning.

Since, the return roller 107 is rotatably supported by the return shaft 104 through the one-way clutch 108 in the direction of pulling back the band 4, the band 4 can not further be pulled back after the band 4 has been firmly wound around the package P. Accordingly, the rocker roller 112 continues rotate at a high speed although the band 4 is substantially stopped. Namely, slippage is caused between the rocker roller 112 and the band 4 while the band 4 is pressed onto the return roller 107. However, the band 4 is not damaged since the outer circumferential surface (i.e., low friction) of the rocker roller 112 is formed to be a smooth surface. Thus, the primary tightening operation is finished.

When the band 4 is about to stop, the return roller 107 driven in accordance with the band 4 as pulled back is also about to stop. In this case, when the rotational speed of the return roller 107 is substantially same as that of the return shaft 104, they are interlocked by means of the one-way clutch 108, whereby the band 4 is tightened by a pulling force of a low speed and high torque of the return shaft 104. Then, when a load greater than a braking force by the secondary tightening-force-adjusting brake (not shown) for a main shaft is applied to the return roller 107, the return roller 107 is stopped. Thus, the secondary tightening operation is finished.

As described above, the band-feeding and tightening apparatus of the present invention is constructed in such a manner that the return roller is always rotated at a low speed; the return rocker roller driven at a high speed is brought into contact with the return roller to perform the primary tightening operation for the band; and the return roller is engaged with the return shaft driven at a low speed and a high torque to perform the secondary tightening operation. Accordingly, only the return roller and the one-way clutch are subjected to change in operations from a high speed to a low speed after the high speed primary tightening operation has finished. Therefore, a shock caused by changing the operations can be remarkably reduced in comparison with the conventional apparatus in which many parts having large mass including the return roller, the return shaft and the friction clutch (the follower part) are subjected to change in the operations.

Even if the band touches with the return roller during feeding of the band, a trouble is not caused because the return roller is rotated at a low speed. The low speed operation for the return roller improves durability of the return roller.

Further, the return roller is rotated at a high speed in accordance with the return rocker roller driven at a high speed interposing the band therebetween, and the return roller does not rotate by the own rotational force. Accordingly, if the running speed of the band becomes slow, the rotational speed of the return roller will be followed. Accordingly, there is avoided between the band and the return roller at a high speed by the cause for, for instance, erroneous adjustment, whereby wearing of the return roller can be prevented.

I claim:

1. A band-feeding and tightening apparatus for a band strapping machine comprising a strapping machine body, a feed shaft supported by said strapping machine body so as to be rotatable in a feed direction at a high speed, a feed roller attached to said feed shaft, a return shaft supported by said machine body in parallel to said feed shaft so as to be rotatable in a return direction, a return roller attached to said return shaft, a first rocker roller adapted to come in press-contact with said feed roller and a second rocker roller adapted to come in press-contact with said return roller, wherein a one-way clutch is interposed between said return shaft and said return roller to allow the rotation of said return roller in said return direction for pulling back a band and to engage said return roller with said return shaft when the rotational speed of said return roller substantially coincides with that of said return shaft and said second rocker roller is rotated at an angular speed higher than that of said return roller.

2. A band-feeding and tightening apparatus according to claim 1, including a belt driven by said feed shaft for rotating said second rocker roller.

3. A band-feeding and tightening apparatus according to claim 1 including a pair of swingable arms operated in association with a cam mechanism for bringing said second rocker roller into press-contact with said return roller.

4. A band-feeding and tightening apparatus according to claim 3, including a shaft supported by said pair of swingable arms, said shaft supporting said second rocker roller and a pulley which is driven by another pulley attached to said feed shaft through said belt and a friction disk interposed between said second rocker roller and said first pulley.

5. A band-feeding and tightening apparatus according to claim 1, wherein said second rocker roller has a smooth outer circumferential surface.

6. A method of feeding and tightening a band in a band strapping machine which comprises feeding a band around a package by bringing a first rocker roller into press-contact with a feed roller rotated at a high speed, performing a primary tightening operation by bringing a second rocker roller driven at a high speed into press-contact with a return roller driven at a lower speed so that said return roller is caused to rotate at a high speed on a return shaft driven at a low speed in accordance with the high speed rotation of said second rocker roller, thereby performing a primary tightening operation, and preforming a secondary tightening operation by engaging said return roller with said return shaft when said band is fitted around a package and a speed of said return roller coincides with the low rotational speed of said return shaft, whereby a rotational force of a low speed and a high torque of said return shaft is transmitted to said return roller in said secondary tightening operation.

* * * * *